US006572429B2

(12) United States Patent
Cheung

(10) Patent No.: US 6,572,429 B2
(45) Date of Patent: Jun. 3, 2003

(54) TOY MODEL BUILDING SET

(75) Inventor: Kwan S. Cheung, So. San Francisco, CA (US)

(73) Assignee: Huntar, Inc., So. San Francisco, CA (US)

( * ) Notice: Subject to any disclaimer, the term of this patent is extended or adjusted under 35 U.S.C. 154(b) by 320 days.

(21) Appl. No.: 09/753,951

(22) Filed: Jan. 2, 2001

(65) Prior Publication Data

US 2002/0086605 A1 Jul. 4, 2002

(51) Int. Cl.[7] ..... A63H 33/06
(52) U.S. Cl. ..... 446/120; 446/122; 446/124
(58) Field of Search ..... 446/85, 102, 119, 446/120, 121, 122, 124, 125, 126, 489, 95; 407/114, 115, 116, 113

(56) References Cited

U.S. PATENT DOCUMENTS 207,562 A * 8/1878 Smith ..... 407/113
2,240,404 A * 4/1941 King ..... 407/113
2,833,082 A * 5/1958 Carson ..... 446/95
4,548,590 A * 10/1985 Green ..... 446/120
5,645,464 A * 7/1997 Chen ..... 446/120
5,738,468 A * 4/1998 Boianjiu ..... 407/113
5,897,417 A * 4/1999 Grey ..... 446/125
6,089,938 A * 7/2000 Spector ..... 446/46

* cited by examiner

*Primary Examiner*—Jacob K. Ackun
(74) *Attorney, Agent, or Firm*—The Kline Law Firm

(57) ABSTRACT

A toy model building set that includes pluralities of generally circular daisy elements, wedge elements, and straight and curved rod elements. The rod elements may be equipped on their ends with various types of connectors, and the rods may be either curved, angled, or straight. The daisy elements can be joined to each other in at least four distinct ways, and can be used as connectors for different elements in a variety of ways. A large plurality of the daisies can be connected together to form a generally planar element. A through hole in the central hub allows the daisy element to receive rod elements in addition to other daisy elements. The wedge elements are pie-shaped elements including two adjoining straight sides and a third curved side. One of the straight sides is equipped with a ball connector, and the other straight side is equipped with a compatible socket connector. Using these connectors, multiple wedge elements can be joined to form circular components such as wheels. The wedge elements also include interior socket connectors.

21 Claims, 10 Drawing Sheets

TOY MODEL BUILDING SET

BACKGROUND OF THE INVENTION

1. Field of the Invention

The present invention relates generally to toys, and more particularly is a toy model building set.

2. Description of the Prior Art

The prior art includes a plethora of references directed to building toys. The line of toys to which the present invention is directed includes such time tested favorites as ERECTOR SETS and TINKER TOYS. While these classics utilized mostly metal and wood components, current art toys are chiefly made of molded plastic.

The common thread between all the model building toys is that they typically comprise at least a plurality of connecting elements and a plurality of structural elements joined with the connecting elements to build the desired models. The point of differentiation for all the various toys is that they vary from each other in the ways that the connecting elements function, and the number and type of structural elements that are available.

Accordingly, it is an object of the present invention to provide a set of model building toys that includes effective and versatile connection means.

It is a further object of the present invention to provide a set of model building toys that includes varied structural elements.

SUMMARY OF THE INVENTION

The present invention is a toy model building set comprising pluralities of generally circular daisy elements, wedge elements, and straight and curved rod elements. The rod elements may be equipped on their ends with ball and socket connectors, or with post and socket connectors. The rods may be either curved, angled, or straight.

The daisy elements can be joined to each other in at least four distinct ways, and can be used as connectors for different elements in a variety of ways. The daisy elements comprise multiple circular knobs joined by a stem to a central hub. A through hole in the central hub allows the daisy element to receive rod elements in addition to other daisy elements.

The wedge elements are pie-shaped elements including two adjoining straight sides and a third curved side. One of the straight sides is equipped with a ball connector, and the other straight side is equipped with a compatible socket connector. Using these connectors, multiple wedge elements can be joined to form circular components such as wheels. The wedge elements also include interior socket connectors.

An advantage of the present invention is that the individual elements are very versatile. A user can connect them in many different ways to enable the formation of a great many different types of structures.

Another advantage of the present invention is that the daisy elements can be joined together to form generally planar elements.

A still further advantage of the present invention is that although the set includes a small number of distinct elements, the versatility of the elements makes possible the construction of nearly any item that can be imagined by the user.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is a toy model building set comprising pluralities of generally circular daisy elements 1, wedge elements 2, rod elements 3 with ball and socket connectors on their ends, and rod elements 3 with post and socket connectors on their ends.

Figure 1:
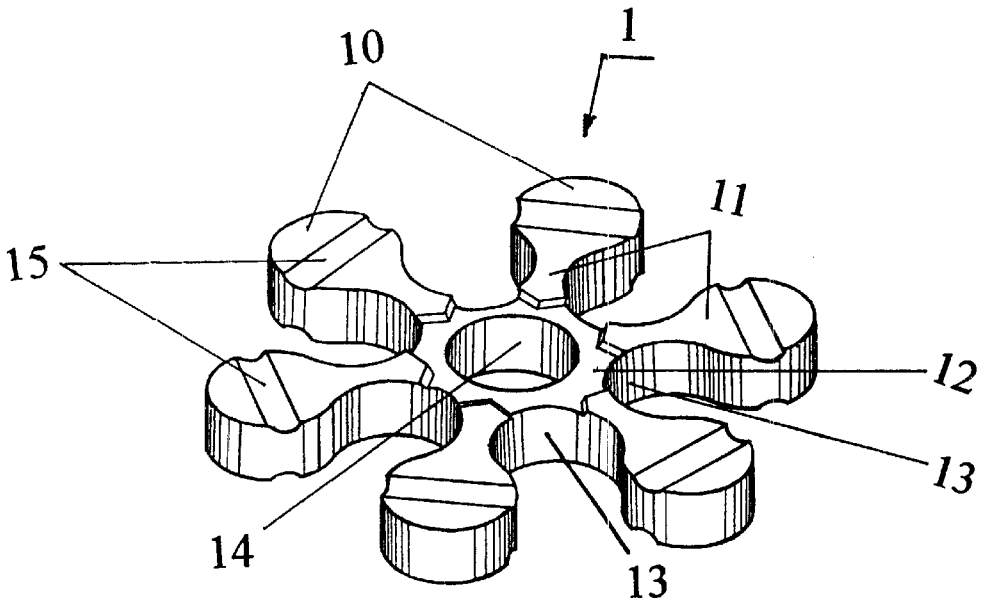
FIG. 1 is a top perspective view of the daisy element of the present invention.
Figure 2:
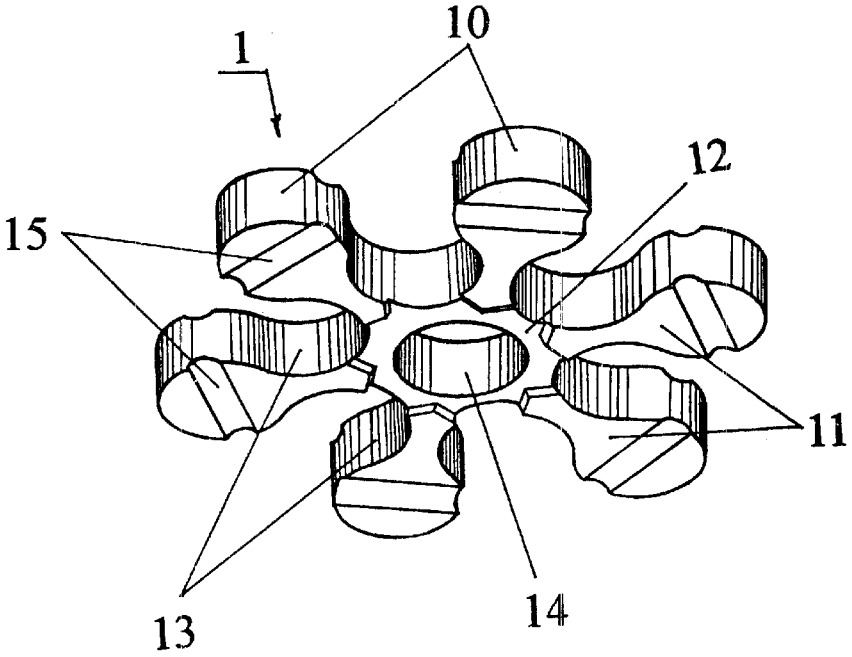
FIG. 2 is a bottom perspective view of the daisy element.

Referring first to FIGS. 1 and 2, the daisy elements 1 comprise a plurality of rounded knobs 10, each of the knobs 10 being joined by a stem 11 to a central hub 12. Pairs of adjoining knobs 10 form a receiving socket 13 that receives both knobs of other daisies and rod elements. The central hub 12 includes a through hole 14 that receives rod elements. Top and bottom surfaces of the knobs 10 include a transverse groove 15. The daisies 1 are constructed so that they can be joined to each other in at least four distinct ways. The top and bottom surfaces of the daisies 1 are mirror images.

Figure 3:
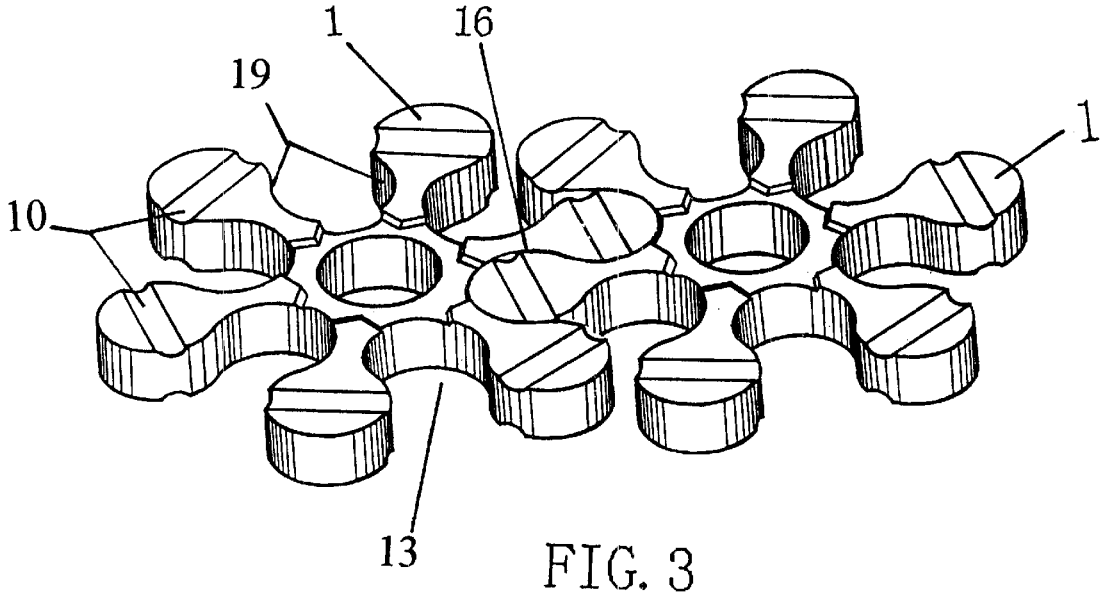
FIG. 3 is a perspective view of a pair of the daisy elements in a first connection mode.

As illustrated in FIG. 3, a first daisy connection mode comprises a knob 10 of a first daisy 1 obliquely inserted into a socket 13 of a second daisy 1. One of the knobs forming the receiving socket 13 of the second daisy 1 is also received in a receiving socket 13 of the first daisy. An S-shaped junction line 16 where sides of the two received knobs 10 lie adjacent each other is formed.

Figure 4:
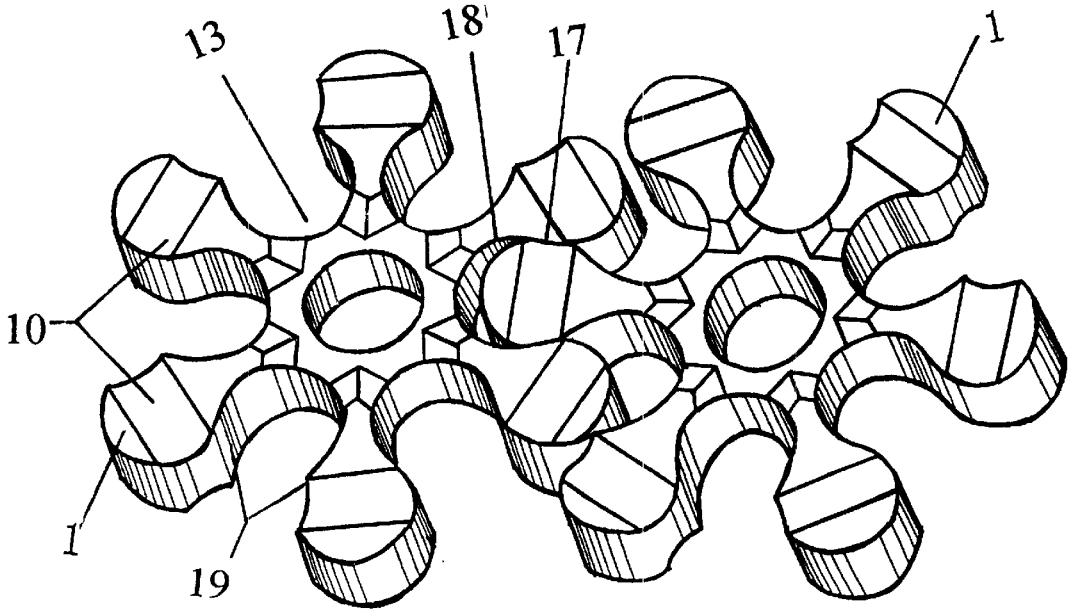
FIG. 4 is a perspective view of a pair of the daisy elements in a second connection mode.
Figure 5:
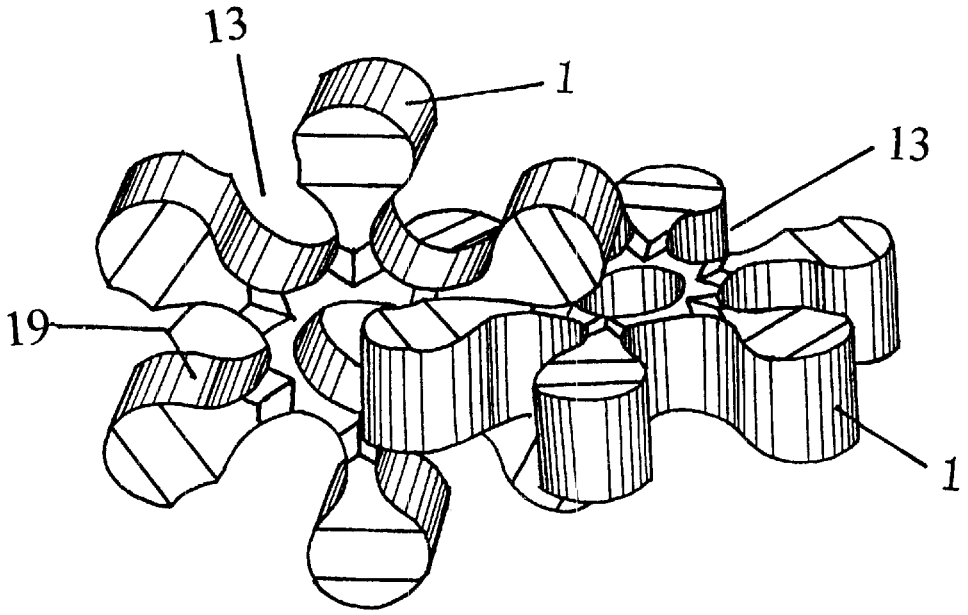
FIG. 5 is a perspective view of a pair of daisy elements in a third connection mode.
Figure 6:
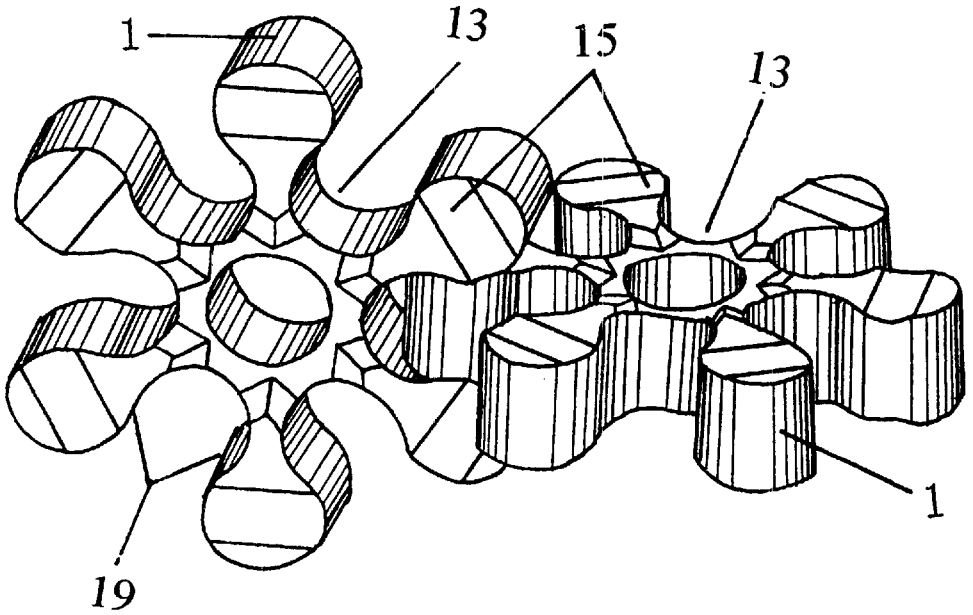
FIG. 6 is a perspective view of a pair of daisy elements in a fourth connection mode.

FIG. 4 displays a second daisy connection mode, wherein a knob 10 of a first daisy 1 is inserted into a socket 13 of a second daisy 1 with a center line of the knob 10 coinciding with a center line of the socket 13. In this orientation, shoulders 19 of the inserted knob 10 form contact points 17 with shoulders 19 of the knobs 10 forming the receiving socket 13. Moreover, ends of the knobs 10 forming the receiving socket 13 form further contact points 17 by abutting the shoulders 19 of the knobs 10 adjacent the knob 12 of the inserted daisy 1. In this connection, a gap 18 is left at the head of the knob 12 in the receiving socket 13. However, the plurality (three in the preferred embodiment) of contact points 17 formed between the knobs 12 ensures a snug joinder of the two daisies 1.

It should be noted that in the first and second connection modes, a large plurality of the daisies 1 can be joined to form a planar element. This capability allows the user of the construction set to build things requiring planar surfaces—walls, etc.—without including the planar surfaces per se in the set. Reducing the number of elements required in the set greatly simplifies the manufacturing process.

Figure 7:
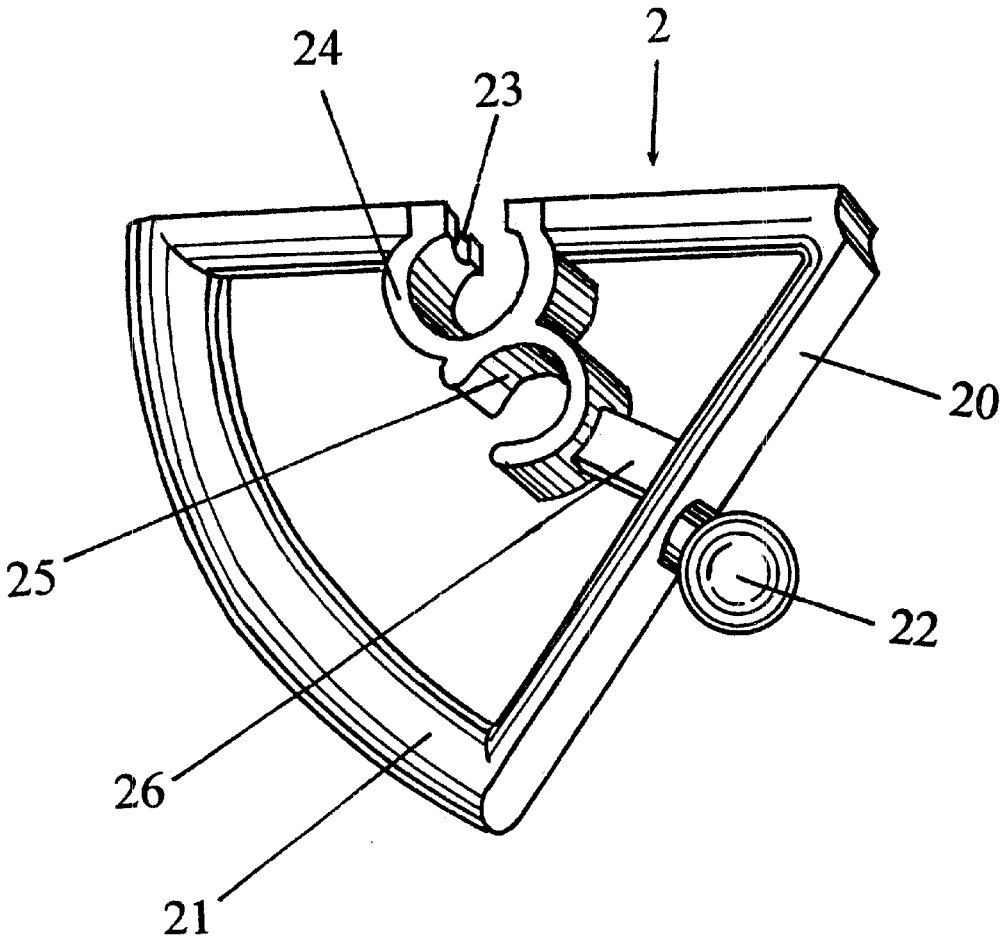
FIG. 7 is a perspective view of a w edge element of the present invention.

FIG. 7 illustrates the wedge element 2 of the present invention. The wedge element 2 is a pie-shaped element including two adjoining straight sides 20 and a third curved side 21. On a first one of the straight sides 20, a protruding ball connector 22 is provided. On a second one of the straight sides 20, there is formed an opening 23 defining a mouth of an outer socket 24. A second socket, inner socket 25, is affixed to the closed back of the outer socket 24. The inner socket 25 is rotated 900 relative to the outer socket 24, so that a side of the inner socket 25 abuts the back side of the outer socket 24. A support brace 26 connects the inner socket 25 to the first straight side 20 to provide stability to the sockets 24, 25. The sockets 24, 25 can receive either ball connectors 22 of other wedges 2, or rod elements 3.

Figure 8:
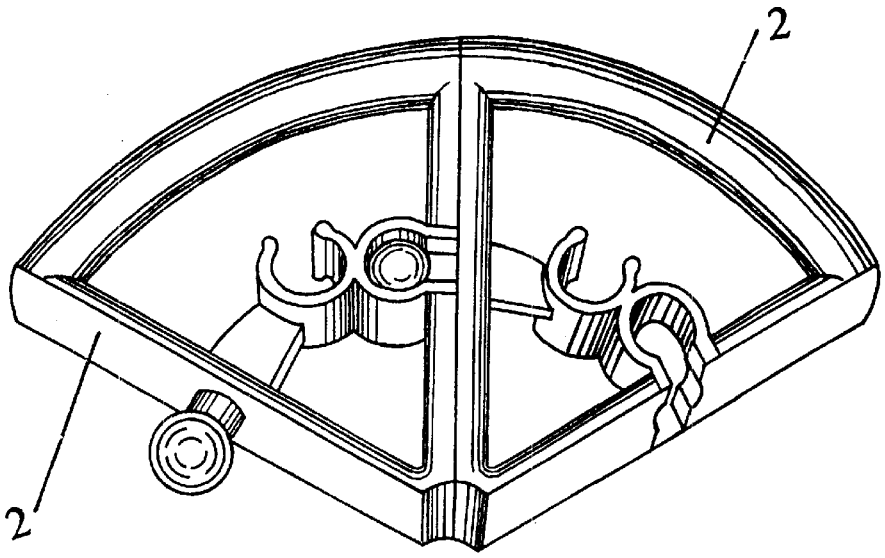
FIG. 8 shows two wedge elements in a side-by-side connection.
Figure 9:
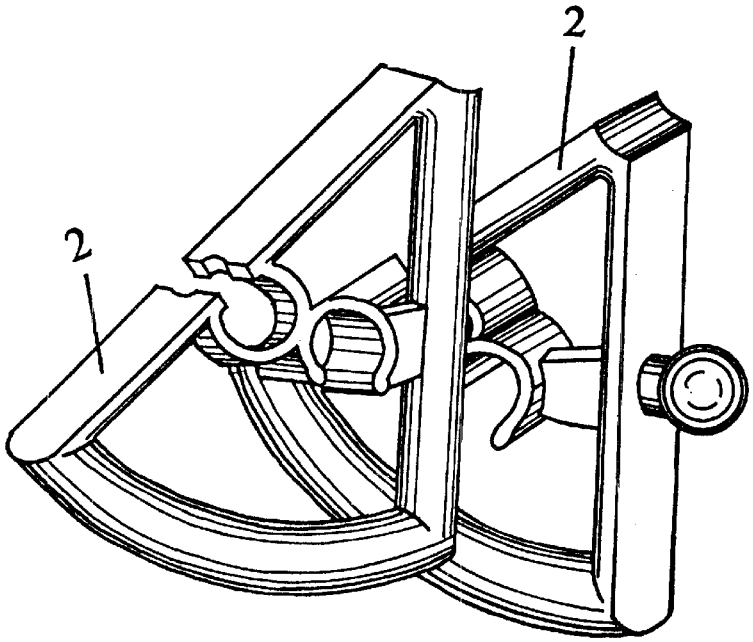
FIG. 9 shows a first wedge element connected to a second wedge element with a ball-and-socket connection.

The arc of the curved side 21 in the preferred embodiment is 60°. Accordingly, when six of the wedge elements 2 are joined side-by-side, using the connection method shown in FIG. 8, a complete circle is formed. The wedges 2 can also be joined in a right angle configuration as illustrated in FIG. 9.

Figure 10:
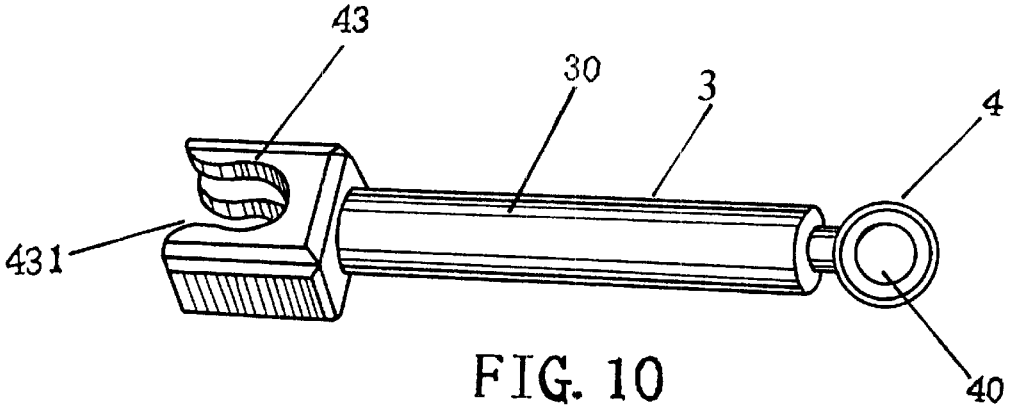
FIG. 10 shows a straight rod element.
Figure 11:
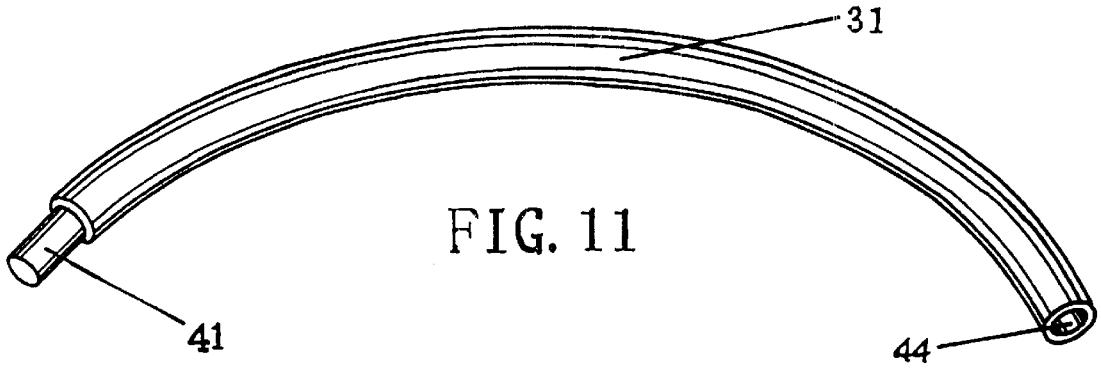
FIG. 11 shows a curved rod element.
Figure 12:
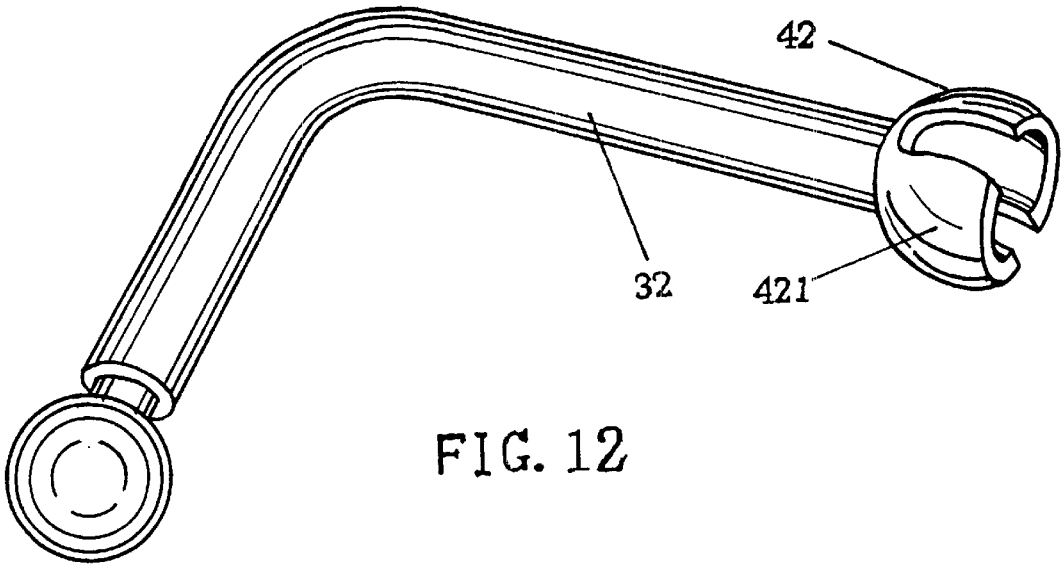
FIG. 12 shows an angled rod element.

FIGS. 10–12 illustrate various rod elements 3 and end connectors 4 of the present invention. The rod elements 3 include at least straight rods 30, curved rods 31, and angled rods 32. The end connectors 4 include both male and female connectors. It should be recognized that any of the end connectors 4 can be utilized in any combination with any of the rod elements 3. Some of the contemplated combinations are illustrated in FIGS. 10–18. Among the myriad end connectors 4 that can be utilized in the present invention are balls 40, posts 41, a rounded cup socket 42, a flat-sided cup socket 43, and a recessed socket 44.

The balls 40 and the posts 41 are the male connector elements and simply extend form the ends of the rod elements 3. The rounded cup socket 42 comprises a pair of rounded side members 421. The flat-sided cup socket 43 comprises a pair of side members 431 that include a rounded interior similar to that of the cup socket 42, but with flat outer side walls 432. The side members 421, 431 are typically made from plastic, as are all the components of the present invention. The side members 421, 431 are therefore deformable when pressed so that the ball 40 can be easily inserted into the socket 42, 43 and securely held therein.

Figure 13:
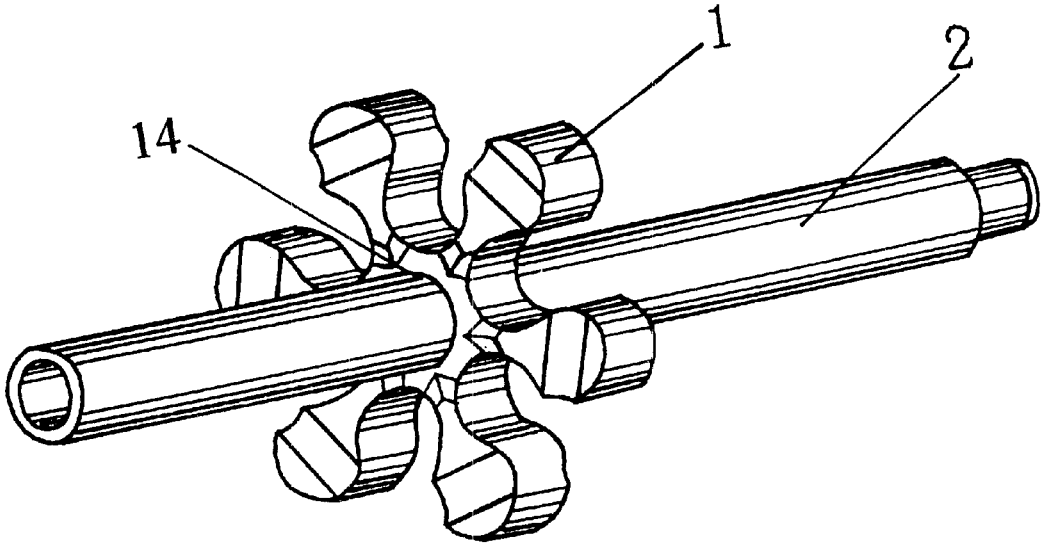
FIG. 13 is a daisy element with a rod through the central through hole.
Figure 14:
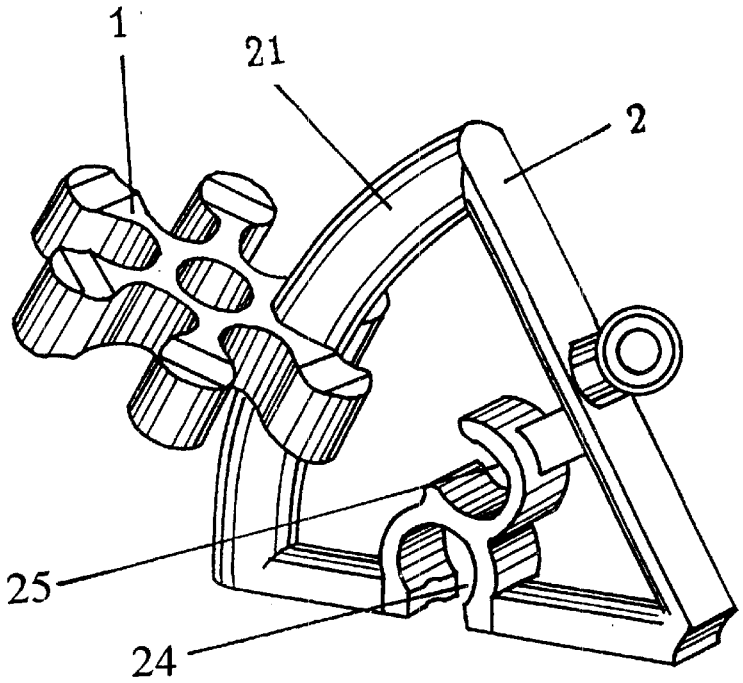
FIG. 14 is a daisy element attached to a wedge element.
Figure 15:
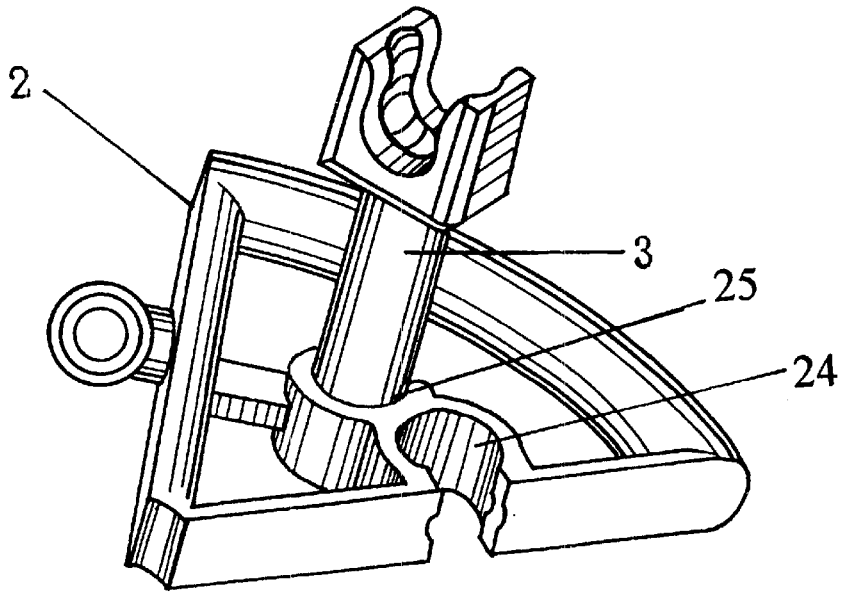
FIG. 15 is a wedge element with a rod through the inner socket.
Figure 16:
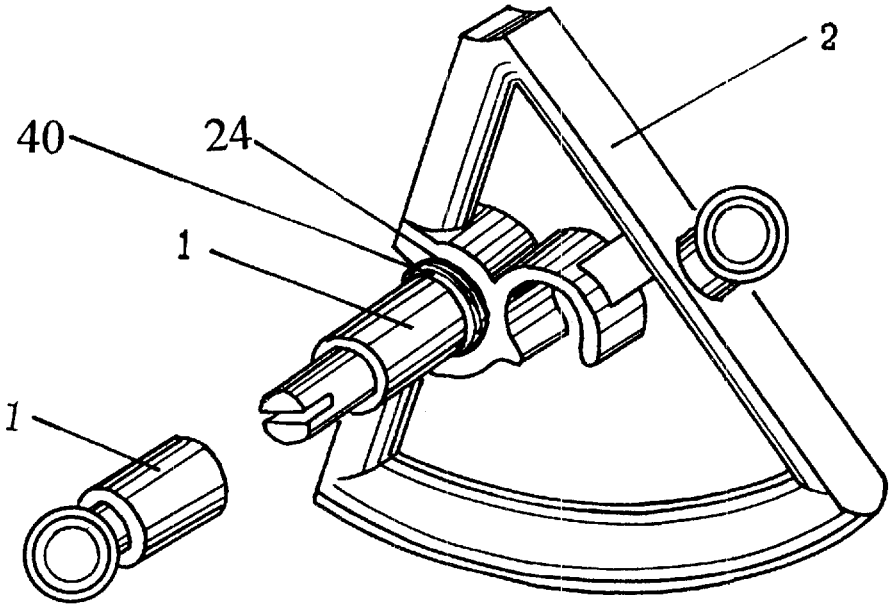
FIG. 16 is a wedge element with a rod inserted into the outer socket via a male connector.
Figure 17:
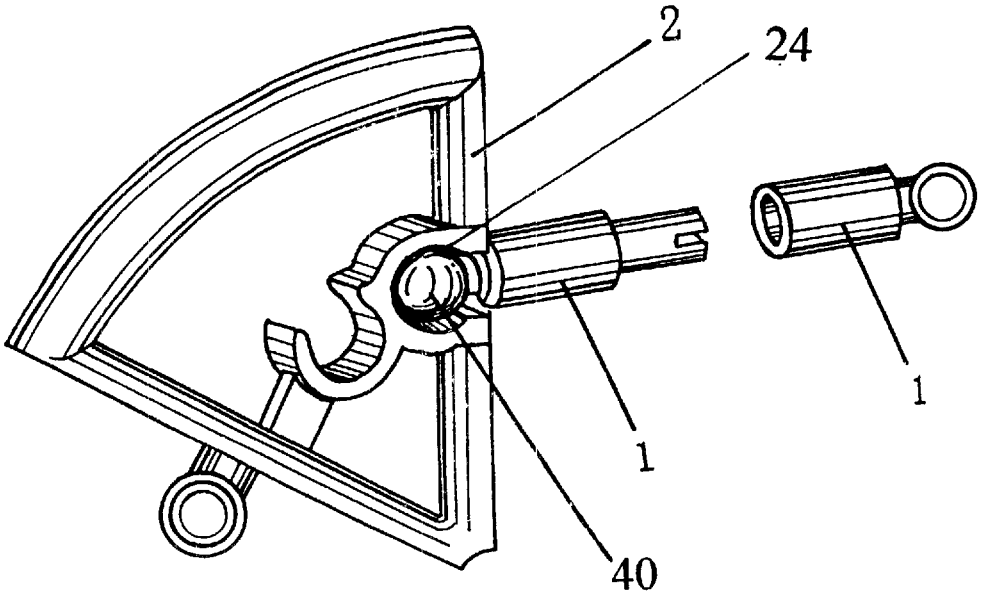
FIG. 17 is a wedge element with a rod inserted into the outer socket via a male connector in a different orientation.
Figure 18:
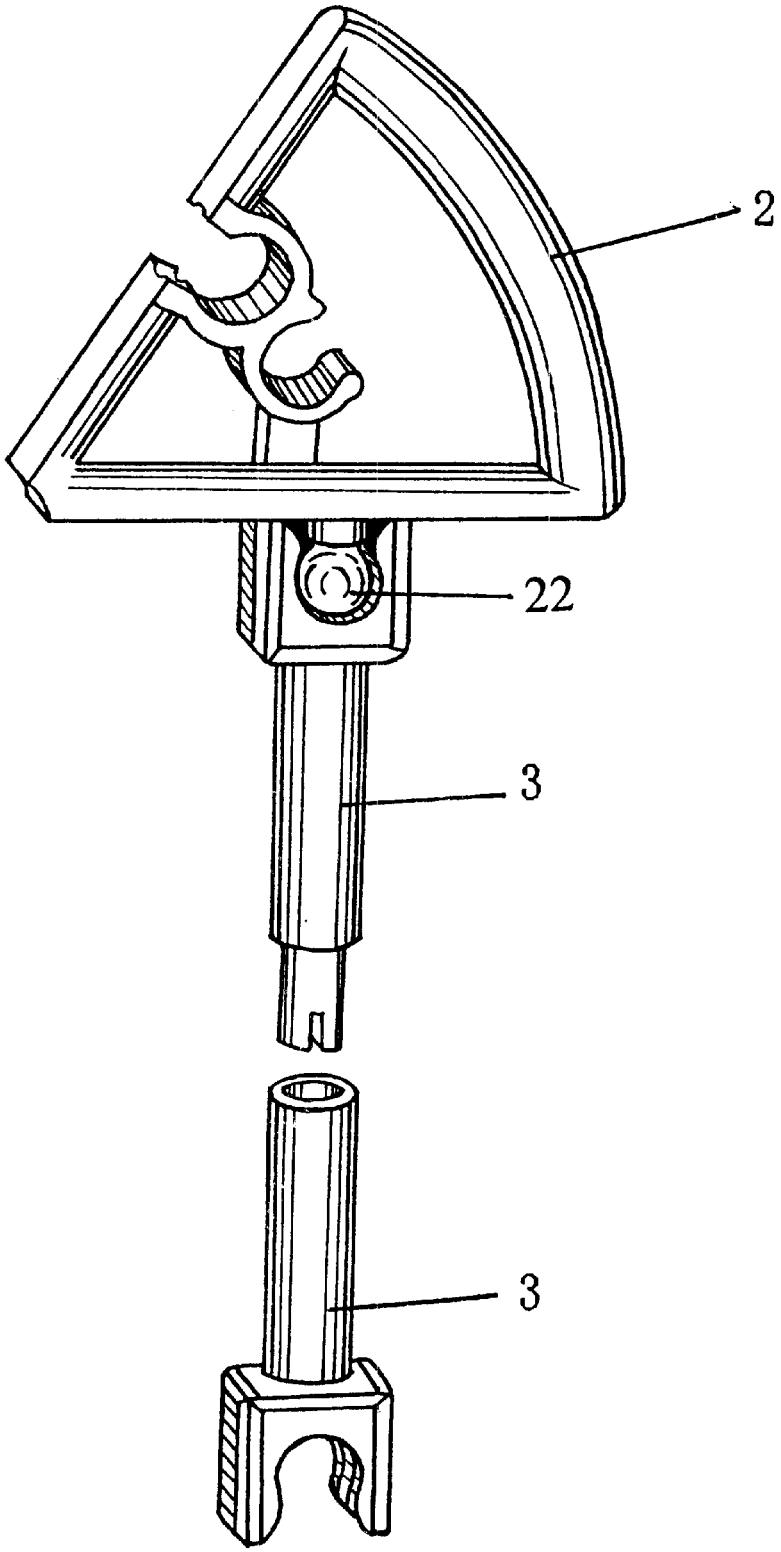
FIG. 18 is a wedge element with a rod connected by means of a female connector element.

FIGS. 13–18 show some of the ways in which the elements of the present invention can be combined. For example, FIG. 13 depicts a daisy element 1 with a rod 3 inserted into the central through hole 14, and FIG. 14 shows a daisy 1 connected to the curved side 21 of a wedge element 2. FIG. 15 shows a rod 3 inserted into the inner socket 25 of a wedge 2. FIG. 16 illustrates a ball connector 40 inserted into the outer socket 24 of a wedge 2, while FIG. 17 shows the same rod 3 combination inserted into the outer socket 24 in a different orientation. FIG. 18 depicts a rod 3 combination attached to the ball connector 22.

The above disclosure. is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A toy model building set comprising:

a plurality of generally circular daisy elements, a plurality of wedge elements, and a plurality of rod elements; wherein ends of said rod elements include connector means, said connector means joining said rod elements with other units of said rod elements, said daisy elements, and said wedge elements, and said daisy elements each comprise a central hub from which extend a plurality of generally circular knobs, each said knob being joined to said central hub by a stem such that shoulders of adjacent pairs of said knobs and corresponding stems of said adjacent pairs of said knobs form a generally circular socket, said socket receiving said rod elements and other units of said daisy elements.

2. The toy model building set of claim. 1 wherein:

said daisy elements comprise connective elements such that multiple units of said daisy elements are joined to each other in multiple ways.

3. The toy model building set of claim 1 wherein:

at least two of said daisy elements are joined together by inserting one of said knobs of a first daisy into one of said sockets of a second daisy, such that a continuous S-shaped junction line is formed where sides of said two knobs lie adjacent each other.

4. The toy model building set of claim 1 wherein:

at least two of said daisy elements are joined together by inserting one of said knobs of a first daisy into one of said sockets of a second daisy with a center line of said knob of said first daisy coinciding with a center line of said socket of said second daisy, such that said shoulders of said knob of said first daisy form contact points with said shoulders of said knobs of said second daisy, ends of said knobs forming further contact points by abutting said shoulders of said knobs adjacent said knob of said first daisy, thereby leaving a gap between said knob of said first daisy and said central hub of said second daisy.

5. The toy model building set of claim 1 wherein:

at least two of said daisy elements are joined together by inserting one of said sockets of a first daisy into one of said sockets of a second daisy such that said central hubs of said first daisy and said second daisy form a right angle.

6. The toy model building set of claim 1 wherein:

at least two of said daisy elements are joined together by inserting shoulders of an adjoining pair of said knobs of a first daisy into grooves on a knob of a second daisy.

7. The toy model building set of claim 1 wherein:

said wedge elements each comprise two straight sides and a third curved side.

8. The toy model building set of claim 7 wherein:

one of said straight sides is equipped with a ball connector.

9. The toy model building set of claim 7 wherein:

one of said straight sides is equipped with a first socket connector.

10. The toy model building set of claim 9 wherein:

a second socket connector means is affixed to said first socket connector.

11. The toy model building set of claim 7 wherein:

a plurality of said wedge elements are attached side by side to form a circular element.

12. A toy model building set comprising:

a plurality of generally circular daisy elements, a plurality of wedge elements, and a plurality of rod elements; wherein ends of said rod elements include connector means, said connector means joining said rod elements with other units of said rod elements, said daisy elements, and said wedge elements, and each said wedge element comprises two straight sides and a third curved side, and each said wedge element comprises integral male and female connector means.

13. The toy model building set of claim 12 wherein:

one of said straight sides is equipped with a ball connector.

14. The toy model building set of claim 12 wherein:

one of said straight sides is equipped with a first socket connector.

15. The toy model building set of claim 14 wherein:

a second socket connector means is affixed to said first socket connector.

16. The toy model building set of claim 12 wherein:

a plurality of said wedge elements are attached side by side to form a circular element.

17. A toy daisy comprising:

a central hub, a plurality of generally circular knobs, and a plurality of stems; wherein said knobs are adjoined to said central hub by said stems, said knobs and said stems being symmetrically disposed about said central hub so as to form a generally circular element, and shoulders of adjacent pairs of said knobs and corresponding stems of said adjacent pairs of said knobs form a generally circular socket, and said daisies comprise connective elements such that multiple units of said daisies are joined to each other in multiple ways.

18. The toy daisy of claim 17 wherein:

at least two of said daisy elements are joined together by inserting one of said knobs of a first daisy into one of said sockets of a second daisy, such that a continuous S-shaped junction line is formed where sides of said two knobs lie adjacent each other.

19. The toy daisy of claim 17 wherein:

at least two of said daisy elements are joined together by inserting one of said knobs of a first daisy into one of said sockets of a second daisy with a center line of said knob of said first daisy coinciding with a center line of said socket of said second daisy, such that said shoulders of said knob of said first daisy form contact points with said shoulders of said knobs of said second daisy, ends of said knobs forming further contact points by abutting said shoulders of said knobs adjacent said knob of said first daisy, thereby leaving a gap between said knob of said first daisy and said central hub of said second daisy.

20. The toy daisy of claim 17 wherein:

at least two of said daisy elements are joined together by inserting one of said sockets of a first daisy into one of said sockets of a second daisy such that said central hubs of said first daisy and said second daisy form a right angle.

21. The toy daisy of claim 17 wherein:

at least two of said daisy elements are joined together by inserting shoulders of an adjoining pair of said knobs of a first daisy into grooves on a knob of a second daisy.

* * * * *